United States Patent [19]

Berger

[11] Patent Number: 5,022,654

[45] Date of Patent: Jun. 11, 1991

[54] LIQUID FILLED DEVICE FOR PLAYING A GAME OF CHANCE

[75] Inventor: Leo Berger, Zürich, Switzerland

[73] Assignee: Idea+Invent AG, Switzerland

[21] Appl. No.: 364,007

[22] Filed: Jun. 9, 1989

[30] Foreign Application Priority Data

Jun. 11, 1988 [DE] Fed. Rep. of Germany ... 8807618[U]

[51] Int. Cl.[5] ..... A63F 9/04

[52] U.S. Cl. ..... 273/145 CA; 273/457; 273/DIG. 24

[58] Field of Search ..... 273/144 R, 144 A, 144 B, 273/145 R, 145 A, 145 C, 145 CA, DIG. 24, 1 L, 350

[56] References Cited

U.S. PATENT DOCUMENTS

| | | | |
|---|---|---|---|
| 2,452,730 | 11/1948 | Carter | 273/145 C |
| 2,738,616 | 3/1956 | Windle | 273/DIG. 24 |
| 2,746,757 | 5/1956 | Frost | 273/145 C |
| 3,360,267 | 12/1967 | Johnson | 273/145 CA |
| 4,239,223 | 12/1980 | Wilson | 273/145 C |
| 4,365,812 | 12/1982 | Martini | 273/146 |

FOREIGN PATENT DOCUMENTS

| | | | |
|---|---|---|---|
| 3538423 | 5/1987 | Fed. Rep. of Germany | 273/145 A |
| 2332777 | 7/1977 | France | 273/145 C |
| 8400280 | 8/1985 | Netherlands | 273/144 B |

*Primary Examiner*—Benjamin Layno

*Attorney, Agent, or Firm*—Paul H. Gallagher

[57] ABSTRACT

A transparent container having a liquid therein, and dice in the liquid, of light weight and thus floating. The container also having therein an object of greater density than the liquid, thus constituting a sinking body. Upon reversing the container top-to-bottom, the dice float to the top and the body sinks to the bottom, wherein the dice and body move in opposite directions, have mutual engagement, or collide, effecting rotation or turning of the dice. When the dice reach the top of the container, the dice are read through the transparent top. In another embodiment, rods are mounted in the container, and extend toward the middle, which the dice engage, and the dice are thereby turned or tumbled. One form includes bars or pieces, instead of dice, with inscriptions thereon. In another form, balls are used and "fall" (rise) into holes in a roulette-type member.

6 Claims, 4 Drawing Sheets

LIQUID FILLED DEVICE FOR PLAYING A GAME OF CHANCE

SUMMARY, AND OBJECTS OF THE INVENTION

The main object of the invention is to provide a game of chance which produces combinations of numbers or zeros or ciphers.

Heretofore there have been what were known as dice boxes. A dice box is in the form of a cup having an open top, and a die was placed in the cup, and the cup then inverted and emptied onto the table, the die falling out the lower, open end. A disadvantage of this is that the die may be lost in emptying the box, and it is an obJect of the invention to provide a device that is more attractive looking, and it avoids the possibility of loss of the die.

The dice are confined within the container, and the container is provided with transparent portions to enable the user to read the dice when they are in their ultimate position.

In one form of the invention, the device includes a container that is entirely closed, i.e. it does not have an open end, and is filled with a supporting medium which may be a liquid or a gas, and it includes a die in the medium that is of lesser density than the medium, and rises therein, toward a floating position, and the device includes obstacles in its interior that are engaged by the die, and the die is thereby turned or given a tumbling effect.

Another obJect of the invention is to provide a device of the foregoing character wherein the dice in moving to their ultimate position for reading, assume such an ultimate position wherein they lie flat or true, that is, never at an angle or a false position, whereby the device can be read correctly in that position.

Another object is to provide such a device having obstacles or protuberances in its interior, so that the dice in rising through the supporting medium, engage obstacles and are turned or deflected, producing an additional element of chance in the game.

Another object is to provide such a game having a novel feature wherein, heavy objects, such as stone particles, are included in the container, these heavy articles being heavier than the supporting medium, so that when the container is so placed, such as in an inverted position, that the dice, which are of light density, then rise through the supporting medium, the heavier articles sink, and the dice and heavy articles interengage or collide, providing a turning or tumbling effect on the dice.

Another object is to provide a device of the foregoing character, in which the light density articles, instead of being dice, are in the form of rods, having code elements, or indicia, imprinted thereon.

Still another object is to provide a device of the foregoing character, which includes a plurality of dividing walls, forming individual cells, and the rods are positioned individually in the different cells, and it is assured that all of the rods reach the upper end of the container, in proper position for reading, whereby it is possible to provide different readings, or slogans, or expressions, in successive plays of the game. These slogans or expressions may be utilized as advertisements. In this embodiment, the container may be provided with a horizontal dividing wall, forming a pair of chambers, one on each side of the dividing wall, and reaching to a transparent element of the container, so that in either of relatively inverted positions of the container, the elements in the upper chamber reach the top in a viewing position.

Another object is to provide a device of the overall general character similar to above, but instead of utilizing dice or corresponding elements, a roulette basin is formed in one end, and a plurality of balls, of a density less than the supporting medium, are utilized, and when the container is turned with the roulette basin at the top, the balls rise through the supporting medium and fall into recesses in the roulette basin. In this form of the device, the roulette basin may be provided with customary colors and descriptions, and the recesses for the balls are observable from either the exterior or the interior of the container, and the user can readily observe the positioning or "choice" of the balls in the roulette basin.

Another object, in the case of the roulette-type device referred to, is that a roulette basin can be located at each end of the container, wherein they are arranged symmetrically, so that the container can be turned in either of opposite positions and the balls will find their way to the roulette basin at the top.

Still another object is to provide a device of the general character referred to above, in which at at least one end, the container is provided with a field, as distinguished from a roulette basin, having numbers identifying the recesses, whereby the balls fall into various ones of the recesses at random, the conclusion of chance being indicated by the numbers at the recesses.

Another object is to provide a container of the foregoing character which is well adapted to the lotto game known as the "6 and 49".

Further objects include the provision of "increased choice", that is, a greater random selection; greater attractiveness., and provision of novel and effective means for compensating for variation in pressure and consequent change in volume in the liquid supporting medium.

The object of the invention arises not only from the features protected by individual claims, but also by the combination of the claims taken together, and in the spatial design disclosed in the drawings.

DESCRIPTION OF A PREFERRED EMBODIMENT

A container 1 is provided which may be entirely transparent, or at least have certain transparent portions as referred to hereinbelow. This container may be of synthetic material, providing the transparency desired. It is entirely and tightly closed, including closure elements 2, 3, at opposite ends which may be referred to as lids. In any one position the ends of course include an upper end and a lower end, but as will be referred to again hereinbelow, the container is variously in different positions, and the end elements 2, 3, assume corresponding positions. The overall shape of the container may be as desired, such as cylindrical, spherical, rhombic, etc.

In the container is a supporting medium 11 which may be either liquid or gas.

The container 1 may be symmetrical about a transverse plane (as viewed in FIG. 1), that is, the ends 2, 3, are identical. However it is within the scope of the invention that the two ends be different, and in consideration of cost, it may be desired to have one end transparent and the other end non-transparent.

Figure 1:
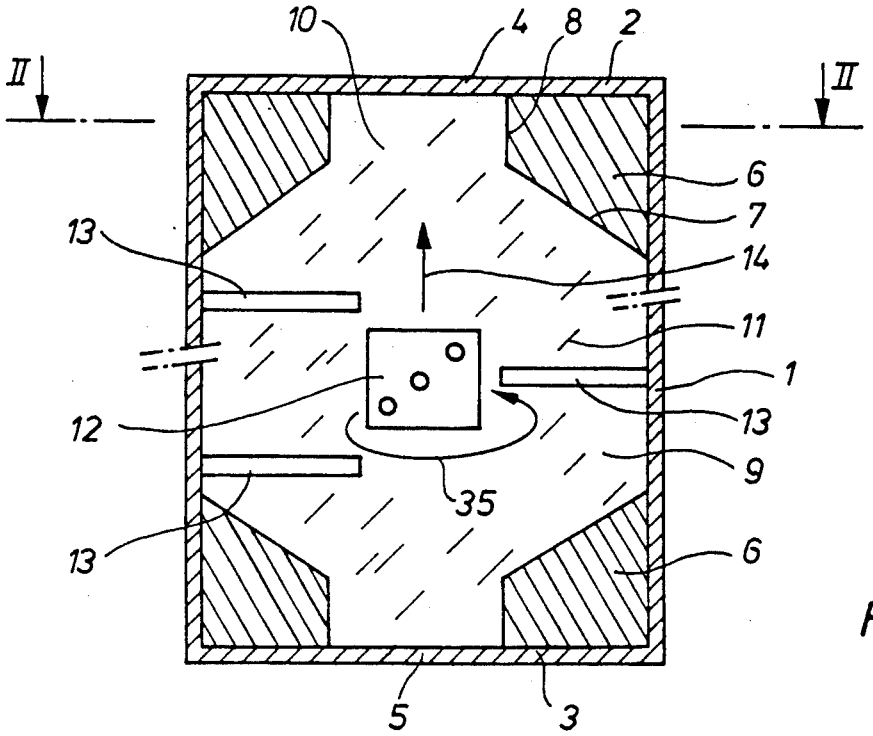
FIG. 1 is a semi-diagrammatic, longitudinal sectional view through one form of the game of chance made according to the invention, and taken at line I—I of FIG. 2.

A plurality of bodies 12 are contained within the container. In FIG. 1, the body 12 is in the form of a die, the die being of lighter density than the medium or fluid 11, and thereby floats or rises to the top of the container. The container may be placed in the position of FIG. 1, and the die 12 previously being positioned at the lower window 5, and upon the container being so positioned, the die floats or rises as referred to, and into a position engaging the upper window 4. This floating action is indicated by the arrow 14.

In FIG. 1 the container is shown having a plurality of rods 13, which may also be referred to as obstacles, secured to the container extending inwardly. These rods may be of different lengths. The die 12 upon rising as referred to above, comes into contact with the obstacles, and it is turned and deflected or tumbled, as indicated by the arrow 35, so that it assumes a random movement, and random positioning at the window 4, with conseque't random presentation of the spots on the die.

The container includes inserts 6, at its ends, each having an opening or narrowing 10 surrounded by a conical surface 7, the latter guiding the die into the space 10.

Preferably the inserts 6 are of foam material which provides an advantage: upon cooling or warming of the fluid 11, the pressure changes in the container, and to avoid undue excess pressure on the container, the foam material yields thereto, as by absorbing the fluid, when the fluid is warmed and consequently expanded. This thereby avoids dangerous excess pressure.

Also, if desired, the die 12 can be made of foam material, with a corresponding effect, that is, it would have a certain capacity of yielding to excess pressure. Also, if desired, the inserts 6 may be dispensed with, and the entire pressure absorption provided by the die 12 itself.

When the inserts 6 are used, the die is automatically centered in the space 10, and the straight cylindrical wall of the insert 6 assures that the die will assume a true position, with a flat side of the die presented flat to the window 4, and not at an angle.

Figure 3:
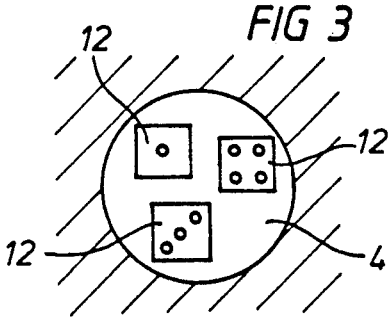
FIG. 3 is a semi-diagrammatic end view oriented according to line II-13 II of FIG. 1.

It is not essential that a single die 12 be utilized, but it is also within the scope of the invention to use a plurality of dice as shown in FIG. 3. In the case of a plurality of dice, the device can be used to play what is known as the "Chicago" game, sometimes also referred to as "26" game.

Figure 2:
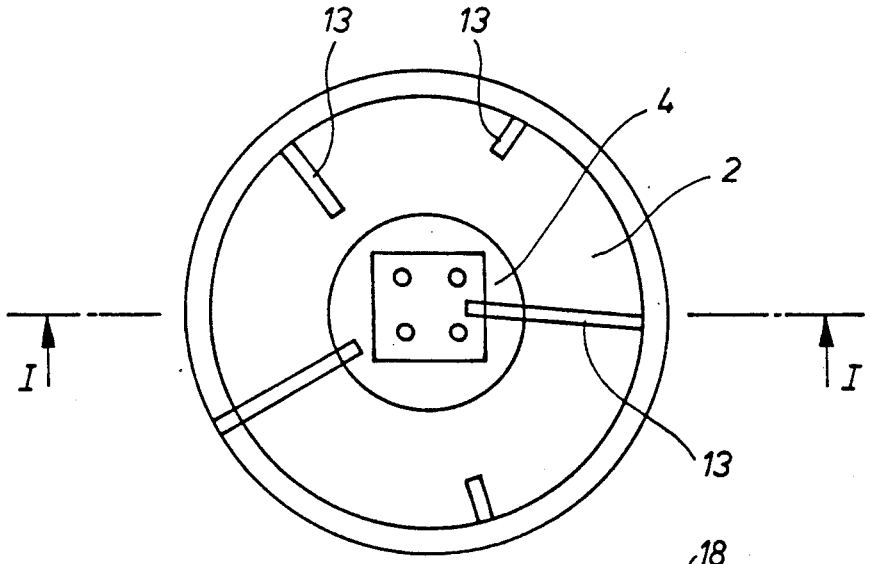
FIG. 2 is a semi-diagrammatic view taken at line II-13 II of FIG. 1.
Figure 4:
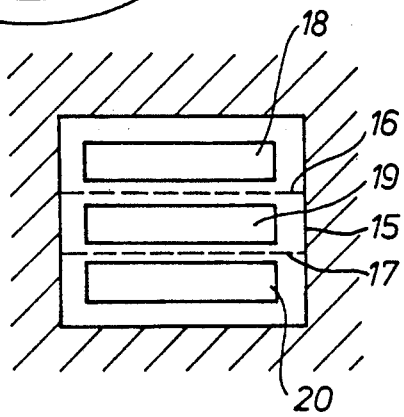
FIG. 4 is a view similar to FIG. 3, but showing the device of FIG. 6.
Figure 5:
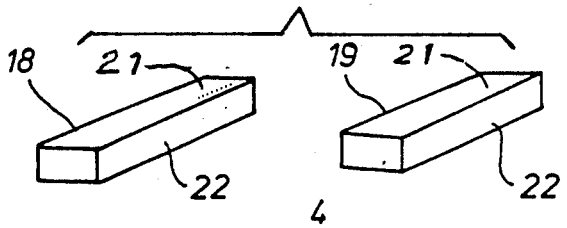
FIG. 5 is a perspective view of floating bodies utilized in the device of FIGS. 4, 6.
Figure 6:
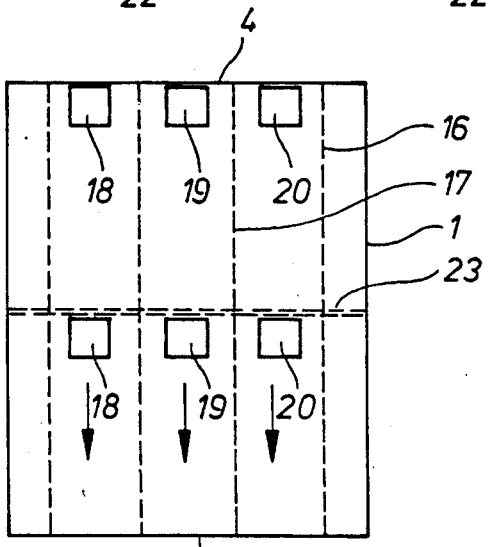
FIG. 6 is a semi-diagrammatic, side view of a modified form of device.

FIG. 4 shows a viewing window 15 similar to that of FIGS. 1, 2, this viewing window also being included in FIG. 6 which is a side view of a modified form of device. In this case bars 18, 19, 20, (see also FIG. 5), which are square or rectangular in cross section, are used, as floating or rising bodies, the side surfaces 21, 22, being provided with different inscriptions. In this case the container 1 is provided with interior boundary walls or dividing walls or partition walls 16, 17, forming individual cells in which the bars are located. The bars are thus segregated from each other, and the bars can turn or rotate about interior longitudinal axes, whereby the bars cannot assume an angular or canted position, but engage the window 4 each with a flat side presented to the window, which can be easily viewed from the exterior.

The device of FIG. 6 has a transverse divider wall 23, dividing the interior into upper and lower parts, in any given position of the device, and the bars can be positioned in each of those parts.

After positioning the device as in FIG. 6, pursuant to a betting step, it is then inverted, and the bars that were in the lower part of the container then move in the direction of the arrows associated therewith, these arrows pointing to the opposite end, which is then the lower end, but in the new position located at the top. These bars can be applied with suitable inscriptions, as indicated, according to the nature of the game being played, and may be slogans, etc.

Pursuant to the container 1 being inverted a number of times, the bars are correspondingly turned, and in successive plays, different surfaces of the bars are presented to the viewing window..The device of FIG. 6 is not limited to bars, that are illustrated, but may be utilized with elements of different shapes, such as dice, prisms, or other geometrical bodies.

Figure 7:
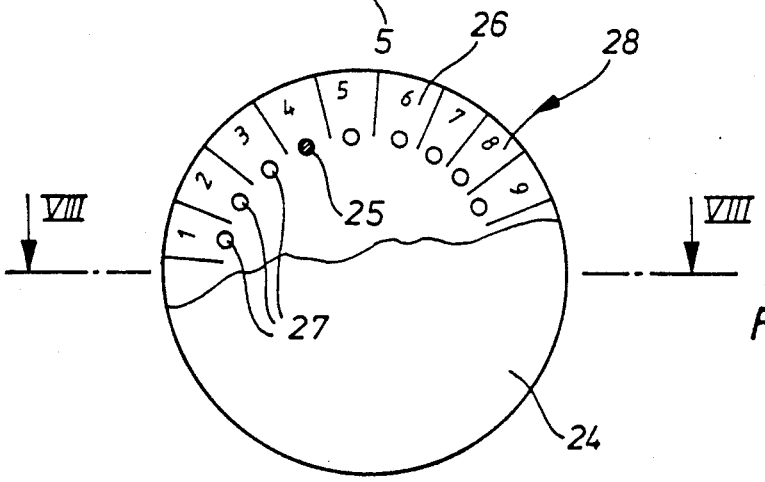
FIG. 7 is a top view of another form of the device, with the end cover partially broken away.
Figure 8:
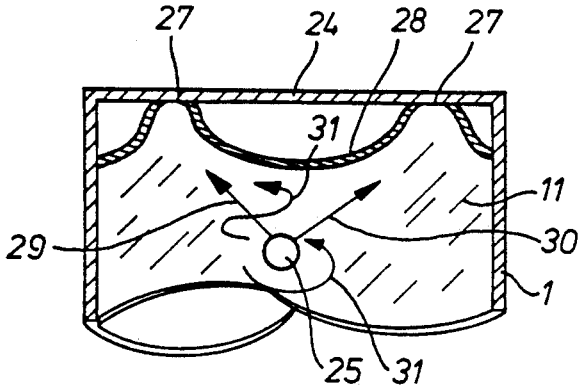
FIG. 8 is a view taken at line VIII—VIII of FIG. 7.

FIGS. 7 and 8 show a third form of the invention, incorporating a roulette game. In this form, and in the shown orientation of the container, the viewing window 24 includes a roulette basin shown particularly in FIG. 8. In this form, the basin has thirty-seven number fields, twenty-six spaced evenly around the circumference, having corresponding or appropriate color and number inscriptions. The basin includes recesses 27, and the elements are so arranged, with the recesses 27 spaced radially inwardly, that the user can observe past the recesses into the interior 9 of the container, as shown in FIG. 7.

In this case a light density ball 25 is positioned in the supporting medium 11, and if desired, obstructions or obstacles, such as 13 in FIGS. 1 and 2, may be utilized in this case also, whereby the ball in rising in the supporting medium engages those obstacles and is turned, as indicated by the arrow 31, and given a random movement, and reaches a random one,of the recesses.

In this case, FIGS. 7 and 8, the roulette basin is formed as a convex insert 28 whereby, the ball in its upward floating movement, as indicated by the arrows 29, 30, can only move into one of the recesses 27, and there be seen from the viewing window 24 so that it can immediately be seen into which recess the ball has "fallen".

In the arrangement of FIGS. 7, 8, another gaming form can be utilized, in that a plurality of balls are used, or corresponding ball "falls" are utilized, whereby only certain ones of the balls float into corresponding recesses, while others, more distant, fail to reach the recesses.

Figure 9:
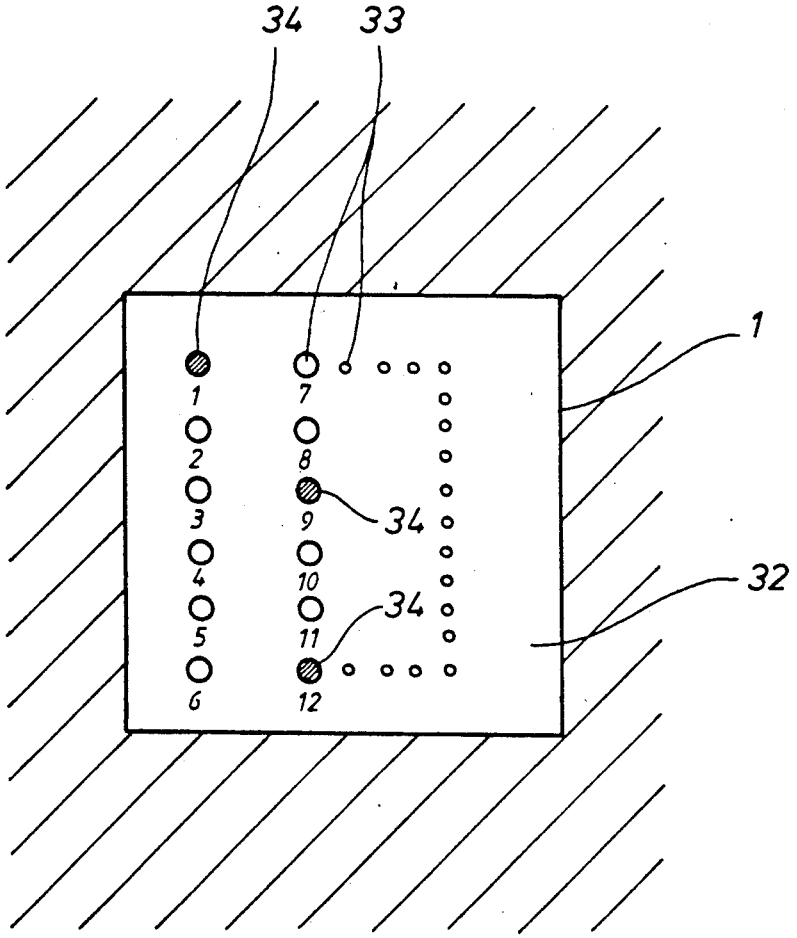
FIG. 9 is a view oriented according to FIGS. 3 and 4, showing another form of the device.

The device of FIG. 9 is particularly adaptable to playing the game known as "6 out of 49". In this case the viewing window 32 is provided with a total of forty-nine recesses 33, and six balls 34 are utilized. The balls may be of different colors, also. The balls fall into the recesses at random, thus constituting an example of the carrying out of the game.

Figure 10:
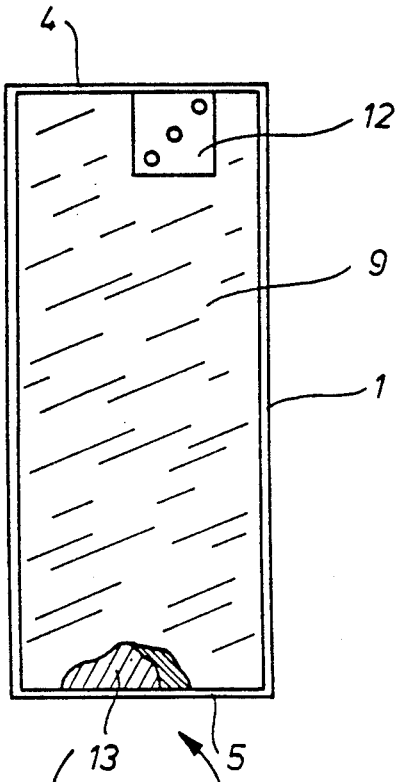
FIG. 10 is a vertical sectional view through a device of another modification.
Figure 11:
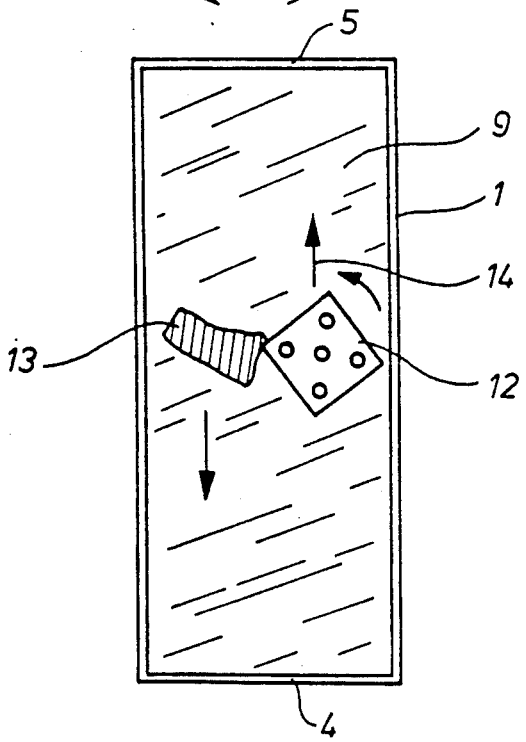
FIG. 11 is a view similar to FIG. 10, but showing the container as positioned immediately after being inverted, with the floating body rising, and the heavy body sinking, and in a position of colliding.

FIGS. 10 and 11 show a different form of the invention, wherein the container 1 has transparent end elements 4, 5, and in the container is a die 12, of light density and floating, and a stone splinter 13, heavier than the medium. In a first position represented in FIG. 10, the die is shown in its upper position engaging the upper window 4 in position for reading, and the heavy stone splinter 13 rests at the bottom. In a step in using the gaming device, the container is inverted to the position of FIG. 11, and after it is so positioned, the heavy stone splinter 13, then at the top, sinks, and the lighter die 12 floats and moves upwardly as indicated by the arrow 14. The two bodies, the stone splinter 13 and the die 12, will come into mutual contact, and thereby the die is turned so that the surface that engages the upper window is indeed random.

In view of the foregoing description of the mechanical construction of the device, and the steps formed in using it, various observations will be apparent. The device can be used for example with differently colored balls for providing the "extra number" recognized in certain gambling games, whereby only a single "throw" of the container is necessary to provide the desired movement, or selection, of the balls.

The device also, if desired, instead of utilizing the floating bodies of the kind referred to above, such as dice, bars, or balls, can be used with differently formed floating or lifting bodies, such as mushrooms, piglets, or other symbol figures.

It is also possible within the scope of the invention, to provide a device having a plurality of different kinds of floating bodies, and different locations in the transparent end elements that whereby the bodies can be readily seen and recognized.

It is also possible and practical to utilize a supporting medium 11 that is florescent, and to utilize a light within the container, if desired.

Regardless what medium is utilized as the supporting medium 11, such for example as a gas, the floating bodies, to be less dense than the medium, may consist of a container or shell filled with a rarer gas.

I claim:

1. A game of chance including a dice box having a container, comprising:

the container including a lid (2,3) on each the upper and the lower side, and filled with a supporting liquid, at least one die (12) and at least one obstacle (13) in the container, the die (12) being of less density than the liquid and thereby constituting a floating body, the obstacle (13) being of greater density than the liquid and thereby constituting a sinking body, and the die and obstacle on rising and sinking respectively coming into mutual contact and thereby causing turning of the die.

2. A game of chance according to claim 1 wherein, a plurality of dice are included in the container.

3. A game of chance according to claim 1 wherein, the obstacle is a shapeless, stone splinter.

4. A game of change according to claim 1 wherein, the container includes partition walls dividing the container into individual cells in each of which is a die and an obstacle.

5. A game of chance according to claim 1 wherein, the supporting liquid is fluorescent.

6. A game of chance according to claim 1 wherein, the container includes yieldable material in its interior yieldable in response to expansion of the supporting liquid.

* * * * *